US007052104B2

(12) United States Patent
Hori et al.

(10) Patent No.: US 7,052,104 B2
(45) **Date of Patent: *May 30, 2006**

(54) ELECTRONIC DEVICE INCLUDING MECHANICAL MODULE AND METHOD FOR OBTAINING ALTERNATIVE CHARACTERISTIC VALUES FOR THE DEVICE

(75) Inventors: Masaaki Hori, Tajimi (JP); Jun Morikawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 293 days.

This patent is subject to a terminal disclaimer.

(21) Appl. No.: 10/671,457

(22) Filed: Sep. 29, 2003

(65) Prior Publication Data

US 2004/0125166 A1 Jul. 1, 2004

(30) Foreign Application Priority Data

Sep. 30, 2002 (JP) ..... 2002-286221

(51) Int. Cl.
*B41J 29/393* (2006.01)
*B41J 23/00* (2006.01)

(52) U.S. Cl. ..... 347/19; 347/37

(58) Field of Classification Search ..... 347/19, 347/37

See application file for complete search history.

(56) References Cited

U.S. PATENT DOCUMENTS

| | | | | |
|---|---|---|---|---|
| 5,424,960 | A | 6/1995 | Watanabe et al. | 702/41 |
| 5,609,426 | A * | 3/1997 | Ito et al. | 400/279 |
| 5,793,177 | A | 8/1998 | Chia | |
| 6,767,080 | B1 * | 7/2004 | Kanematsu | 347/60 |
| 2004/0125155 | A1 * | 7/2004 | Murakami et al. | 347/5 |

FOREIGN PATENT DOCUMENTS

| | | |
|---|---|---|
| JP | A-55-71196 | 5/1980 |
| JP | A 55-71196 | 5/1980 |
| JP | A-6-115202 | 4/1994 |
| JP | A-9-135597 | 5/1997 |
| JP | B2 3075839 | 6/2000 |

* cited by examiner

*Primary Examiner*—Thinh Nguyen
(74) *Attorney, Agent, or Firm*—Oliff & Berridge, PLC

(57) ABSTRACT

A carriage motor is driven with a predetermined duty value and it is determined whether a carriage is moved. If it is determined that the carriage is moved, a lower duty value is set. If it is determined that the carriage is not moved, a higher duty value is set, in order to obtain the duty values at the time when the carriage is and is not moved. The duty values when the carriage is moved and is not moved, are stored, as alternative characteristic values, in an EEPROM in association with positional information of duty value detection position. Therefore, quality control may be properly performed by checking the stored duty values.

28 Claims, 6 Drawing Sheets

ELECTRONIC DEVICE INCLUDING MECHANICAL MODULE AND METHOD FOR OBTAINING ALTERNATIVE CHARACTERISTIC VALUES FOR THE DEVICE

BACKGROUND OF THE INVENTION

1. Field of Invention

The invention relates to an electronic device including a mechanical module and a method for obtaining alternative characteristic values for the electronic device.

2. Description of Related Art

Known information technology (IT) devices, such as facsimile machines and printers, produce print output onto a recording sheet by driving components or units thereof using motors, such as DC motors and pulse motors. Ideal drive conditions of components of an IT device, such as voltage and current, are determined at the design stage of the IT device, based on results of tests performed for individual prototype components or overall prototype devices, as well as by considering possible variations of loads applied due to, for example, environmental conditions.

For example, for carriages of dot printers and ink-jet printers in which print heads move across a recording sheet, the drive conditions, such as voltage and current, may be determined to allow for variations due to environmental conditions, after moving loads are measured using, for example, a sprint scale.

After the drive conditions are determined, the measurements are carried out again using an actual device to confirm whether the device works as designed. If the device does not work properly, the device conditions are changed, for example, by increasing voltage or current. The optimum drive conditions obtained through tests are adopted as the ultimate drive conditions for the device.

For example, Japanese Laid Open Patent Publication No. 55-71196 discloses a method in which time required for a motor to start operating is measured by applying predetermined current. Based on measurement results, impact or degree of loads applied to the motor is determined by values of the current as alternative characteristic values of the loads. This method may be effective at the research and development stage, or design stage where the current may be easily changed, but not at the product manufacturing or repairing stage where current or voltage values are difficult to change. Consequently, the confirmation made at the product manufacturing (shipment) or repairing stage is to inspect whether an IT device actually works with the determined design values.

It is difficult to know how high an operational margin (allowance for loads applied by the setting current/voltage) of each product is, from the above-described confirmation or inspection made at the time of shipment or repair. When low-margin products are placed in the market, the products may possibly malfunction at customers site, as components of the products are worn out during usage and the drive loads applied are increased.

When the products are not assembled properly, for example, a component is missing, loads applied to the products may vary. As described above, it is only confirmed at the product manufacturing or repairing stage whether products work properly with the design values. Therefore, differences of the loads between the actual products and the design value are not confirmed. In addition, allowing for a margin of operations of the products, voltage and current tend to be set to a greater values. Due to such settings, the products may seemingly work properly during the confirmation or inspection at the manufacturing or repairing stage, even when the products are poorly assembled. If problems attributable to, for example, poor assembly are be found after the products are subjected to all processes of assembly or repair, the products have to be disassembled and reassembled to find out causes of the problems, resulting in unfavorable quality and manufacturing controls.

SUMMARY OF THE INVENTION

Accordingly, one aspect of the invention is to provide an electronic device including a mechanical module whose quality is readily and simply controllable and a method for obtaining alternative characteristic values to perform proper quality control for the electronic device.

An electronic device including a mechanical module according to the invention may include a drive source that provides drive force to the mechanical module, a power supply device capable of supplying drive power to the drive source while changing the drive power, a detector that detects a condition change of the mechanical module from a static condition (stationary or unmoving condition) to a dynamic condition (moving or operating condition), when the power supply device supplies the drive power to the drive source while changing the drive power, and a storage device that stores a value, at a time of detection by the detector, that is associated with the drive force of the drive source or the drive power, as an alternative characteristic value of static load on the mechanical module.

In the electronic device including the mechanical module, when the power supply device supplies the drive power to the drive source while changing the drive power, the condition change of the mechanical module from the static condition to the dynamic condition may be detected using the detector. A value of the drive force of the drive source or the drive power at a time when the detector detects the condition change, may be stored in the storage device, as the alternative characteristic value of the static load on the mechanical module. The electronic device of the invention may store the alternative characteristic value of the detected static load in the storage device. Accordingly, by checking the stored alternative characteristic value, quality control for the electronic device including the mechanical module may be properly performed.

In the electronic device of the invention, it may be determined whether the mechanical module is non-conforming by comparing the duty value that has been stored before shipment and that obtained after the shipment at the time of an inspection.

The electronic device of the invention may detect the condition change of the mechanical module from the static condition to the dynamic condition, not conditions of the drive force. Therefore, the alternative characteristic value, that is, impact or degree of loads applied to the mechanical module, may be obtained in a simpler manner than that disclosed in the above-described Japanese Laid Open Patent Publication No. 55-71196.

In the case where the mechanical module includes a guide shaft, a carriage that reciprocates along the guide shaft, a print head mounted on the carriage, and a transmission device that transmits the drive force from the drive source to the carriage, it may be preferable that the detector detect the condition change of the carriage from the static condition to the dynamic condition, along the guide shaft. Generally, the static load will be an issue for the operation controls of carriages in electronic devices. Therefore, by detecting the condition change of the mechanical module from the static condition to the dynamic condition, the static load may be determined. Accordingly, quality control for the electronic device including the mechanical module may be properly performed.

A method for obtaining an alternative characteristic value, according to the invention may be executed in an electronic device including a mechanical module, a drive source that provides drive force to the mechanical module, a power supply device capable of supplying drive power to the drive source while changing the drive power, and a storage device that stores therein the alternative characteristic value. The method may include the steps of supplying the drive power from the power supply device to the drive source while changing the drive power, detecting a condition change of the mechanical module from a static condition to a dynamic condition, when the power supply device supplies the drive power to the drive source while changing the drive power in the supplying step, and storing in the storage device a value, at a time of detection in the detecting step, that is associated with the drive force of the drive source or the drive power, as the alternative characteristic value of static load on the mechanical module. By checking the alternative characteristic value obtained by the method of the invention, quality control for the electronic device including the mechanical module may be properly performed.

A method for obtaining an alternative characteristic value used for the mechanical module including a guide shaft, a carriage that reciprocates along the guide shaft, a print head mounted on the carriage, and a transmission device that transmits the drive force from the drive source to the carriage, includes the step of detecting the condition change of the carriage, from the static condition to the dynamic condition along the guide shaft, when the power supply device supplies the drive power to the drive source while changing the drive power. If the method is used, quality control for the electronic device, such as printers, including the mechanical module may be properly performed.

BRIEF DESCRIPTION OF THE DRAWINGS

An embodiment of the invention will be described with reference to the accompanying drawings in which.

DETAILED DESCRIPTION OF PREFERRED EMBODIMENTS

A printer 1 according to the embodiment is of an ink-jet type. Briefly stated, when the printer 1 is instructed to form an image, the printer 1 ejects ink onto a recording sheet supplied from a sheet supply unit, based on image information input from an external device. The sheet having the image formed thereon is discharged from the printer 1.

Figure 1:
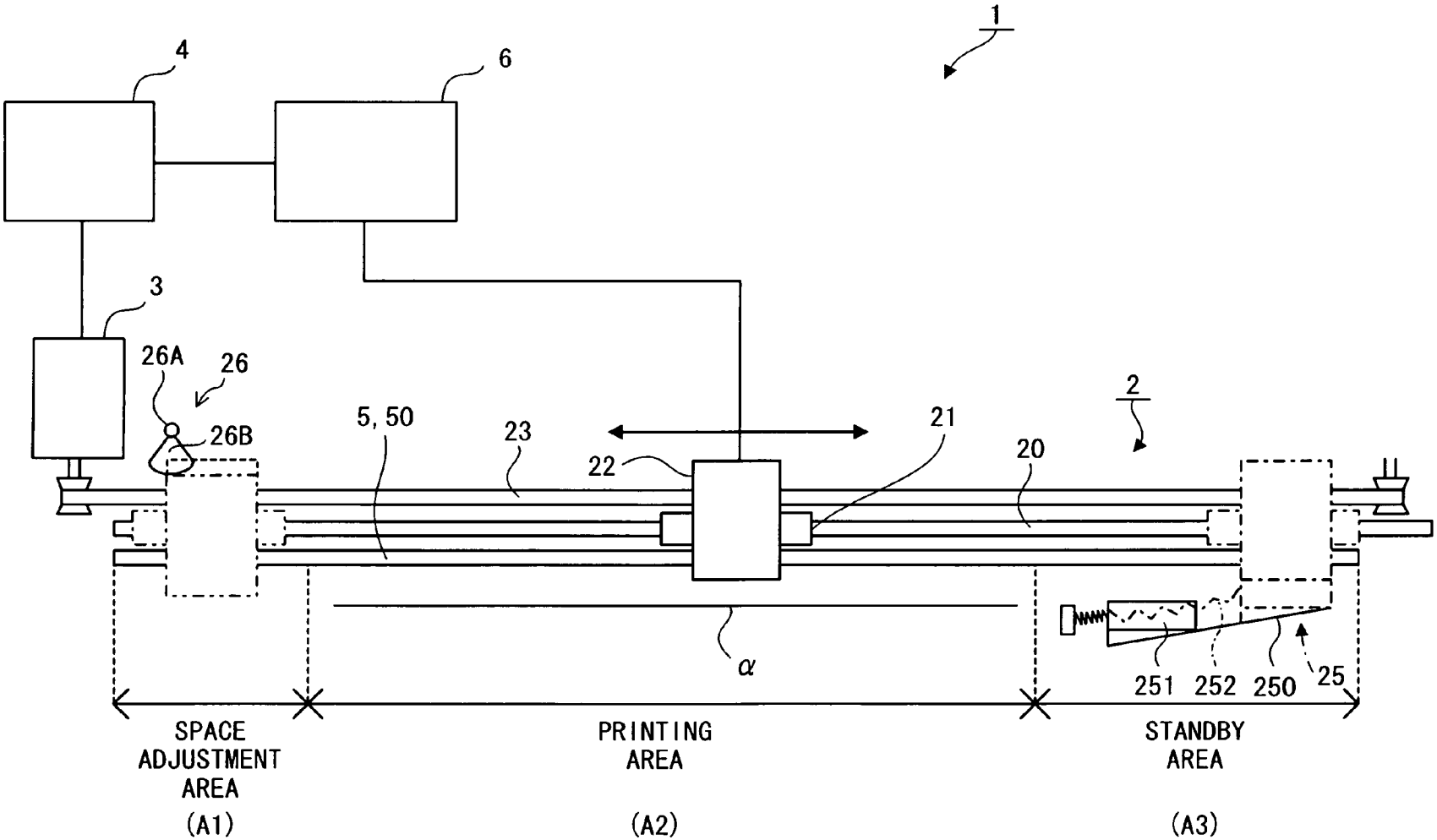
FIG. 1 is a schematic diagram showing a printer according to an exemplary embodiment of the invention.

A printer 1 will be described in detail below with reference to FIG. 1. FIG. 1 only shows components of the printer 1 relevant to the invention, and some components, such as sheet feeding and discharging mechanisms are omitted to simplify the illustration.

The printer 1 includes a mechanical module 2, a carriage motor 3, a carriage motor drive circuit 4, a detector 5, and a controller 6. The mechanical module 2 includes a guide shaft 20, a carriage 21, a print head 22, and a moving belt 23.

The guide shaft 20 is disposed vertically and horizontally to a sheet feeding direction, which is perpendicular to the sheet of FIG. 1.

The carriage 21 is provided so as to reciprocate along the guide shaft 20.

The print head 22 is mounted on the carriage 21. The print head 22 is provided with an ink tank (not shown) that stores therein a plurality of colors of ink. The print head 22 ejects ink onto a sheet $\alpha$ under the control of the controller 6.

The moving belt 23 is an endless belt disposed parallel to the guide shaft 20. The carriage motor 3 is connected to the moving belt 23, to convey drive force of the carriage motor 3 to the carriage 21. The carriage 21 and the print head 22 move along the guide shaft 20 while being guided by the moving belt 23.

On a side of an end of the guide shaft 20 of the mechanical module 2 is a standby area A3 (FIG. 1) where the print head 22 stands by while an image forming operation is not performed. A capping device 25 that covers an ink ejecting surface of the print head 22, is provided in the standby area.

On a side of the other end of the guide shaft 22 of the mechanical module 2 is a space adjustment area A1 (FIG. 1) where a space between the print head 22 and the sheet $\alpha$ is adjusted according to the thickness of the sheet $\alpha$. A space adjustment device 26 that adjusts the level of the print head 22 is provided in the space adjustment area.

The capping device 25 is disposed on the right end side of the guide shaft 22 in FIG. 1, out of a printing area A2 (FIG. 1). The capping device 25 includes a slope 250 that is uptilted outwardly from the printing area, a cap 251 that is slidable along the slope 250, and a spring 252 that pulls the cap 251 toward the lower side of the slope 250. The carriage 21 is provided with a hook (not shown). When the carriage 21 is moved from the printing area A2 to the standby area A3 along the guide shaft 20, the hook is caught in the cap 251. In this state, as the carriage 21 is further moved to the right side in the standby area 3, the carriage 21 pulls the cap 251 along the slope 250. When the carriage 21 reaches the right end of the standby area A3, the cap 251 covers the ink ejecting surface of the print head 22. Thus, the carriage 21 moves the cap 251 along the slope 250, against an urging force of the spring 252, so that considerable load is applied to the carriage 21, unlike that applied to the carriage 21 in the printing area A2.

As the carriage 21 in the standby area A3 with the print head 22 covered by the cap 251 is moved toward the printing area 2, the cap 251 urged by the spring 252 is pulled downwardly toward the lower side of the slope 250, along with the carriage 21 moving toward the printing area A2. As the hook of the carriage 21 is released from the cap 251, the cap 251 is moved to the position shown by the solid line in FIG. 1.

The space adjustment device 26 is disposed on a rear side of the carriage 21. In FIG. 1, when the carriage 21 that is located in the printing area A2 and the standby area A3, the space adjustment device 26 is not shown. Rather, the device 26 is only illustrated with the carriage 21 in the space adjustment area A1. The space adjustment device 26 adjusts the space between the print head 22 and the sheet $\alpha$, according to the thickness of the sheet α. The space adjustment device 26 includes a shaft 26A and an adjustment portion 26B pivotable about the shaft 26A. The adjustment portion 26B has a substantially sectorial shape in a plane view, with each radius (length from the shaft 26A to the outside edge of the adjustment portion 26B) being different. A protrusion (not shown) is formed on a frame (not shown) of the printer 1. Depending on how far the carriage 21 moves leftward within the space adjustment area A1, it is determined whether the adjustment portion 26B contacts the protrusion. As the adjustment portion 26B contacts the protrusion, the adjustment portion 26B pivots about the shaft 26A. Accordingly, a portion of the adjustment portion 26B to contact the rear side of the carriage 21 is changed. Consequently, the carriage 21 is mechanically moved in a direction vertical to the sheet α of FIG. 1. As the print head 22 is mounted on the carriage 21, the space between the print head 22 and the sheet α is adjusted. To adjust the space between the print head 22 and the sheet α, the adjustment portion 26B has to pivot about the shaft 26A while contacting the protrusion formed on the frame, so that considerable load is applied to the carriage 21 in the space adjustment area A1, unlike that applied to the carriage 21 in the printing area A2. Once the space between the print head 22 and the sheet α is adjusted, the space therebetween is not changed until space readjustment is performed.

For the carriage motor 3, a stepping motor or a DC motor may be used. The carriage motor 3 provides drive force to the carriage 21, through the moving belt 23.

The carriage drive circuit 4 supplies drive power to the carriage motor 3.

Figure 2:
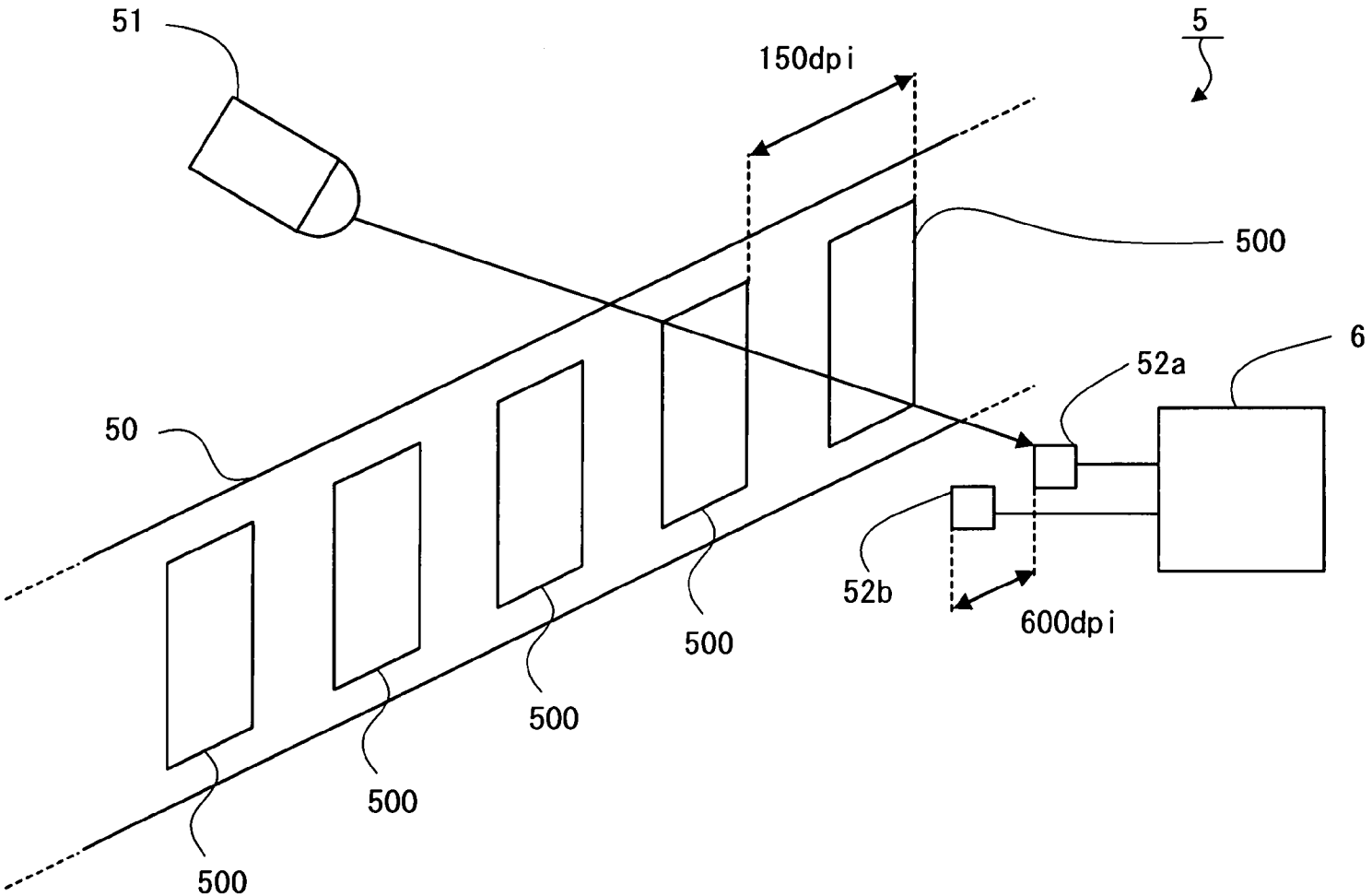
FIG. 2 is a schematic diagram showing an encoder of the printer according to the embodiment of the invention.

The detector 5 detects a moving direction and moving amount of the carriage 21. As shown in FIG. 2, the detector 5 includes an encoder strip 50, a light emitting device 51, and two photoreceptors 52*a*, 52*b*.

The encoder strip 50 is disposed along the guide shaft 20 in the frame (not shown) of the printer, so as to cover a moving range of the carriage 21. The encoder strip 50 has a plurality of slits 500 formed thereon along the longitudinal direction at an interval of 150 dpi (dot per inch). The slits 500 allow light to pass therethrough. Portions of the encoder strip 50 other than the slits 500 do not pass light therethrough.

In the exemplary embodiment, the light emitting device 51 is a light emitting diode. The light emitting device 51 is disposed in the carriage 21 at a position away from a surface of the encoder strip 50 by a predetermined distance, and vertical to the surface of the encoder strip 50.

The photoreceptors 52*a*, 52*b* are disposed across the encoder strip 51 from the light emitting device 51. The photoreceptors 52*a*, 52*b* are disposed in the carriage 21 at 600 dpi distance therebetween in the longitudinal direction of the encoder strip 50, so as to face the light emitting device 51. The photoreceptors 52*a*, 52*b* are connected to the controller 6.

Figure 3:
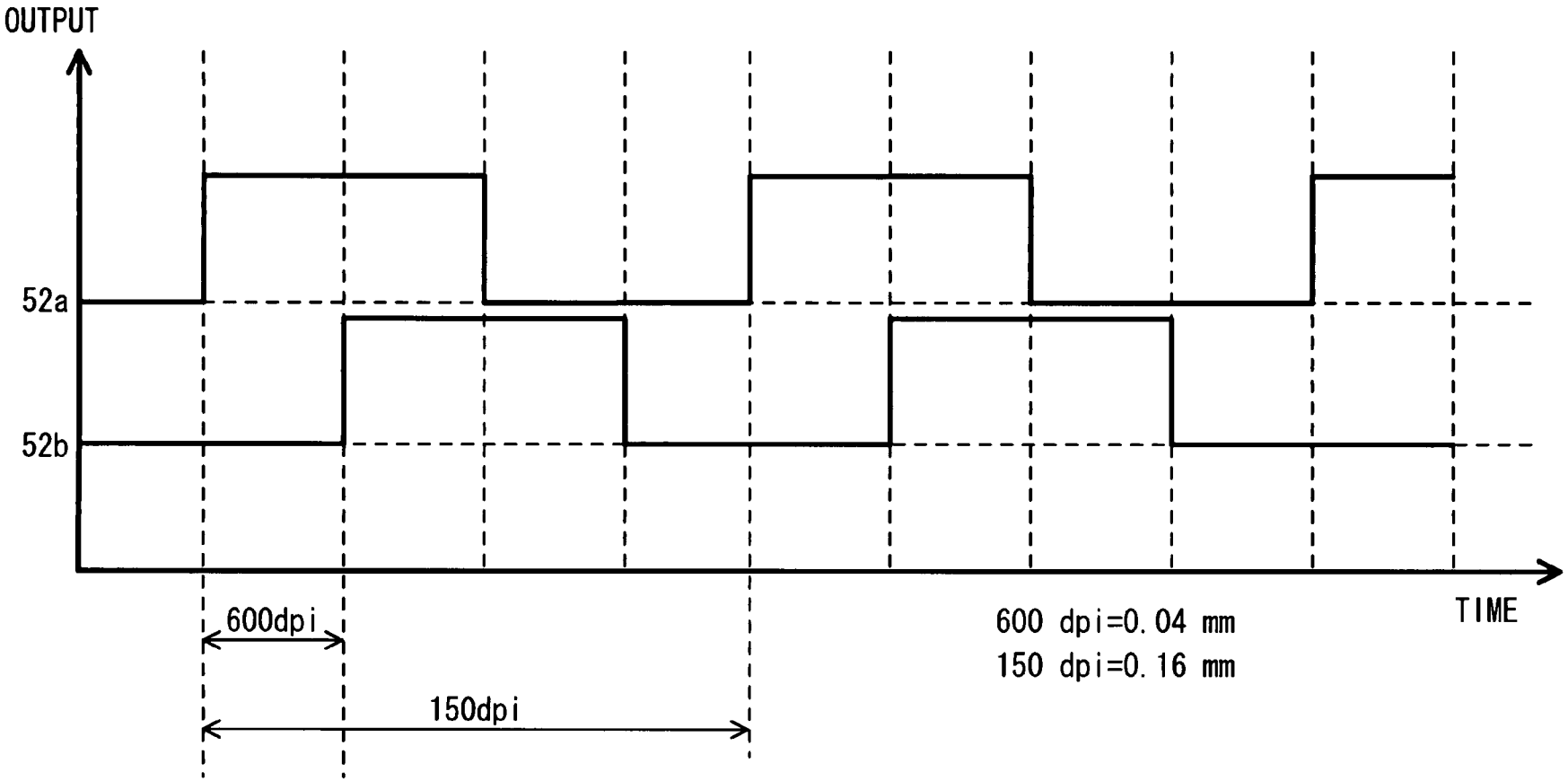
FIG. 3 is a time chart showing output of ON-OFF signals from a photoreceptor according to the embodiment of the invention.

As the light emitting device 51 emits light during the movement of the carriage 21 passes across the slit 500, the photoreceptors 52*a*, 52*b* receive light from the light emitting device 51, through the slits 500. The photoreceptors 52*a*, 52*b* do not receive the light from the light emitting device 51, as the light emitting device 51 emitting light passes across a portion of the encoder strip 50 between the slits 500. Depending on the reception or non-reception of the light from the light emitting device 51, the photoreceptors 52*a*, 52*b* output ON/OFF signals at a predetermined time interval, as shown in FIG. 3. As the photoreceptors 52*a*, 52*b* are disposed 600 dpi away from each other, the ON/OFF signals from the photoreceptors 52*a*, 52*b* are output in a 600 dpi phase shift. In accordance with the changes of a moving direction of the reciprocating carriage 21, ON/OFF signal outputs from the photoreceptors 52*a*, 52*b* are changed.

Figure 4:
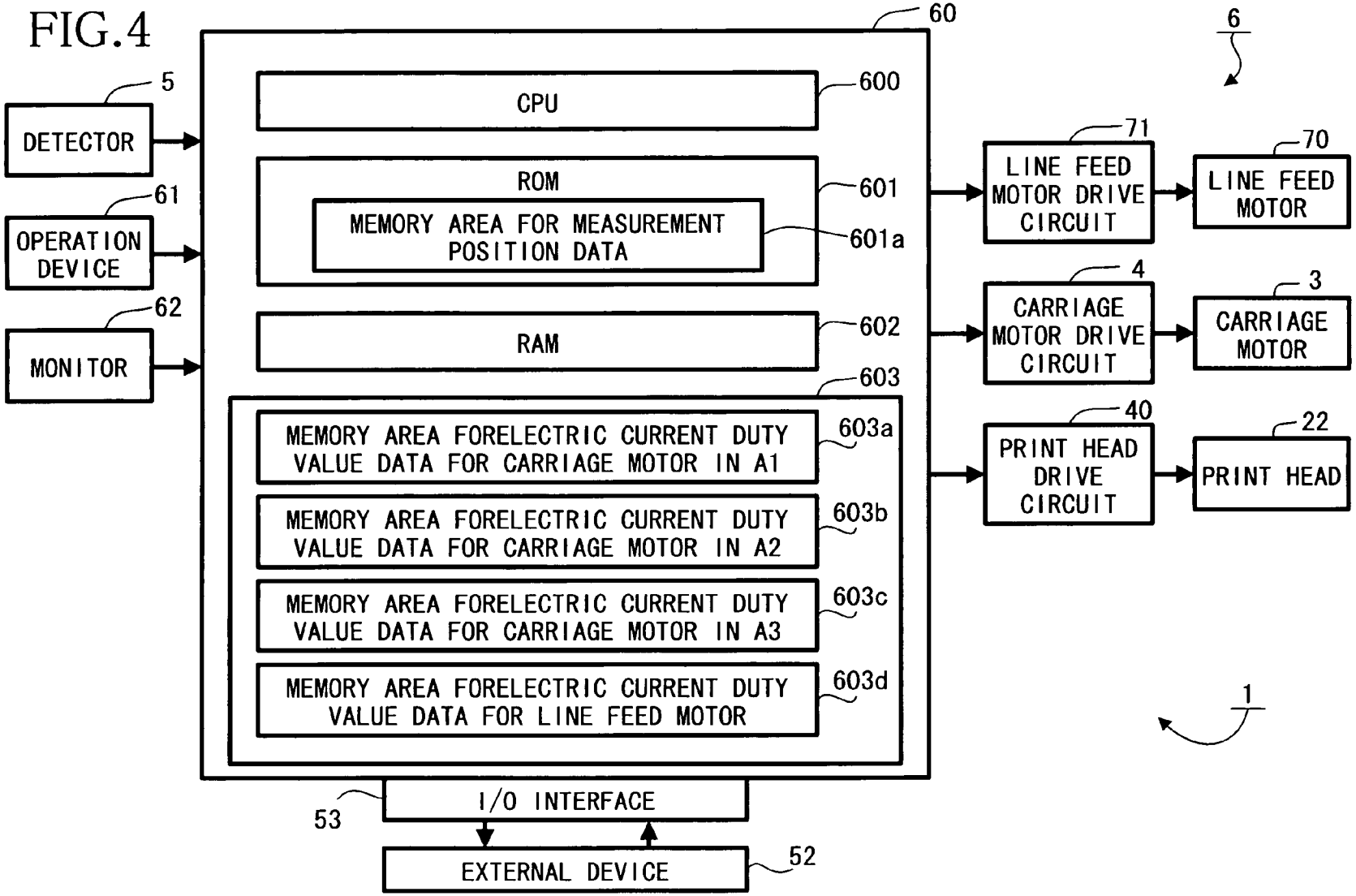
FIG. 4 is a block diagram of a controller of the printer to the embodiment of the invention.

The controller 6 of the printer 1 will be described with reference to FIG. 4. The controller 6 includes a control device 60. Connected to the control device 60 are an operation device 61 that a user uses for operations of the printer 1, a monitor 62 that displays information, such as characters, setting values, and telephone numbers, and the detector 5 that detects the moving direction and moving amount of the carriage 21.

The control device 60 includes a CPU (central processing unit) 600, a ROM (read-only memory) 601, a RAM (random-access memory) 602, and an EEPROM (electrically erasable programmable ROM) 603. The ROM 601 stores in a memory area 601*a*, measurement position data regarding a plurality of positions where moving loads of the carriage 21 are measured. The EEPROM 603 stores data regarding electric current duty value applied to the carriage motor 3, in memory areas 603*a*, 603*b*, 603*c* in association with the measurement positions of the moving loads, as well as another data regarding electric current duty value applied to a line feed motor 70 in a memory area 603*d*. The electric current duty value data stored in the memory areas 603*a*, 603*b*, 603*c* is associated with the space adjustment area A1, printing area A2, and standby area A3, respectively. Further, the control device 60 is connected to a carriage motor drive circuit 4 for driving the carriage motor 3, a print head drive circuit 40 for driving the print head 22, and a line feed motor drive circuit 71 for driving the line feed motor 70, controlling the operations of the printer 1.

In addition, the control device 60 is connected, through an input/output (I/O) interface 53, to an external device 52, such as a personal computer. The data from the external device 52 can be printed by the printer 1.

The carriage motor drive circuit 4 and the line feed motor drive circuit 71 can perform pulse width modulation (PWM) control for the carriage motor 3 and the line feed motor 70. With the PWM control, motor drive power is changed, without changing voltage or current supplied to the motors 3, 70, by changing the ratio of the ON time to the OFF time of current supply during a predetermined time. More specifically, the drive power supplied to the motors 3, 70 is controllable by changing the duty values, which represent the ON time or the OFF time of current supply during the predetermined time, instead of changing the voltage or current supplied to the motors 3, 70.

As described above, the printer 1 is provided outside the printing area A2 with the space adjustment device 26 and the capping device 25 that impose loads on the movement of the carriage 21. The loads applied through the moving range of the carriage 21 are shown in FIG. 6.

Figure 6:
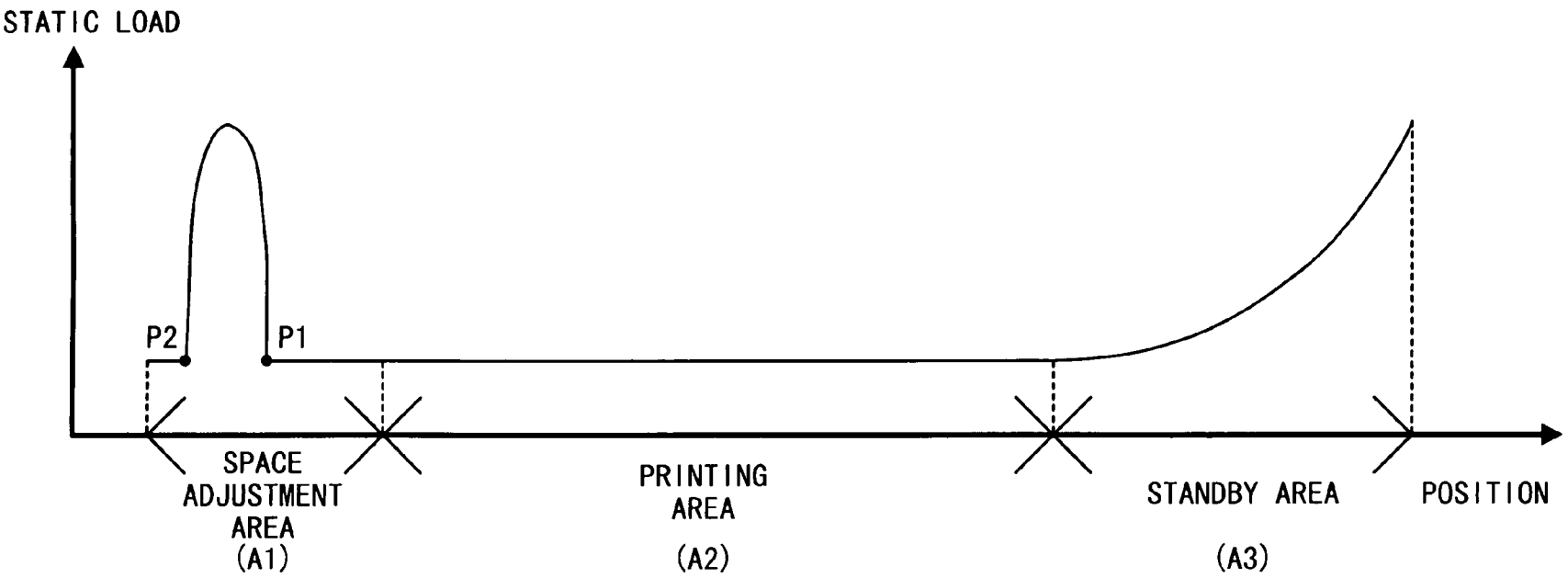
FIG. 6 is a graph showing a characteristic curve of load.

In FIG. 6, the horizontal axis represents positions where the carriage 21 moves across the sheet α in the lateral direction (right and left sides in FIG. 1). The vertical axis represents static load, that is, load required for transition from a static condition (stationary or unmoving condition), to a dynamic condition (moving or operating condition). More specifically, the static load in this embodiment is the load resulting from static friction and the start of a motor.

The static load imposed on the carriage 21 is almost constant in the printing area A2. In the space adjustment area A1, the static load is almost constant except for a position where the space adjustment device 26 and the carriage 21 contact each other to change the distance between the carriage 21 and the sheet α. In the standby area A3, the static load gradually increases until the carriage 21 moves to the right end of a capping position where the cap 251 of the capping device 25 covers the ink ejecting surface of the print head 22, because the carriage 21 is moved against the elastic force of the spring 252.

Figure 5:
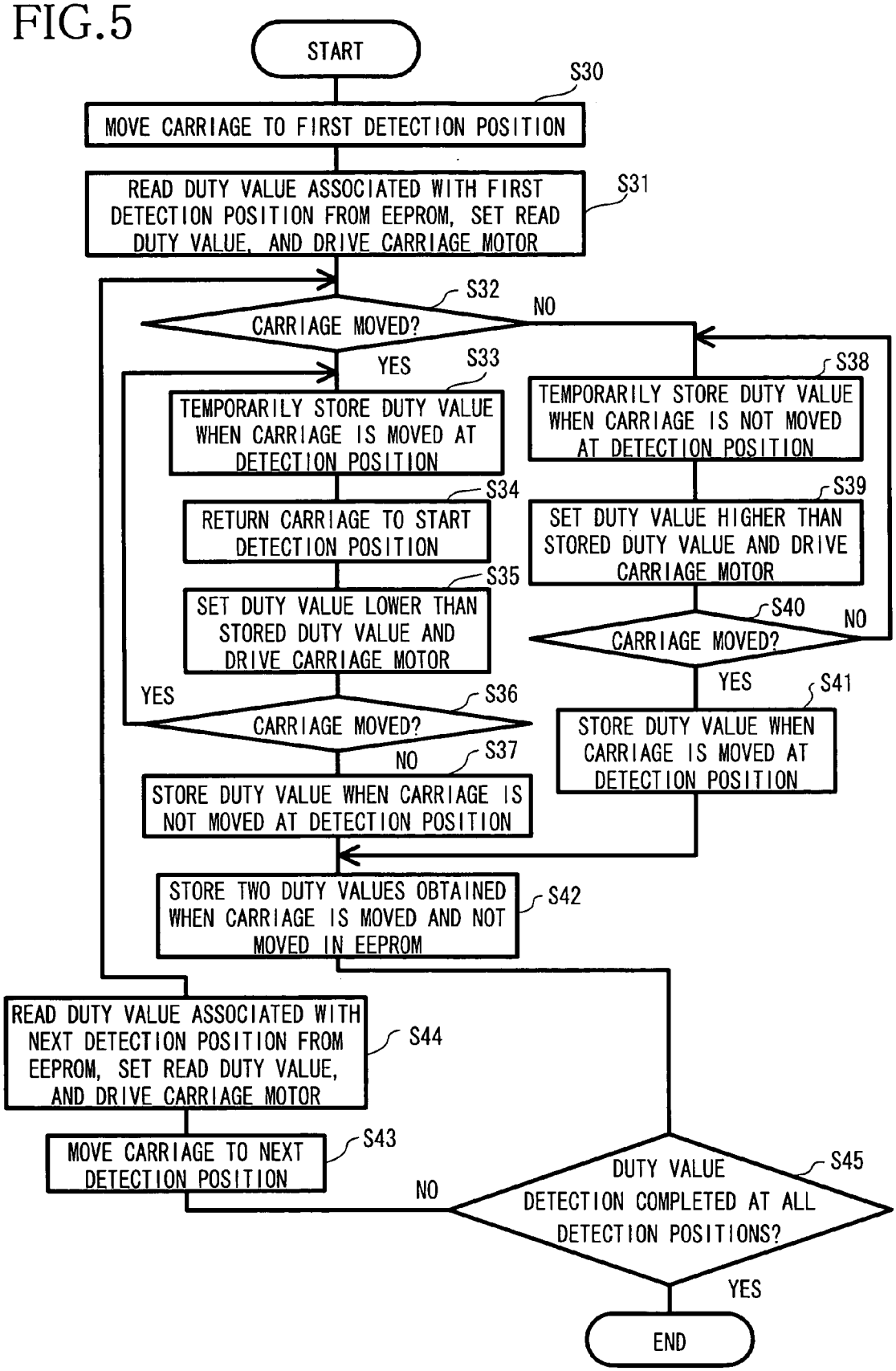
FIG. 5 is a flowchart showing a process for obtaining an alternative characteristic value.

The carriage 21 can move properly without problems if the electric current duty value required to exceed maximum static load of each area is applied according to the areas. The printer 1 according to the exemplary embodiment is structured such that the maximum static load (electric current duty value) can be detected to obtain an alternative characteristic value for the operation of the carriage 21. In the printer 1 structured as described above, a process for obtaining an alternative characteristic value with respect to operation controls of the mechanical module 2 associated with the carriage 21, will be described with reference to FIG. 5. The process may be hereinafter referred to as the "alternative characteristic value obtaining process."

The alternative characteristic value obtaining process is started, as an instruction to obtain the alternative characteristic value is performed with the operation device 61. As the process is started, the CPU 600 moves the carriage 21 to a predetermined first detection position, based on the measurement position data stored in the memory area 601*a* of the ROM 601. It is preferable that a plurality of measurement positions be set throughout a moving range of the carriage 21 for drive controls of the carriage 21. However, an increase in the number of measurement positions results in an increase in the amount of time required for the alternative characteristic value obtaining process. Taking the time required for the process into account, the number of the measurement positions may be determined. For example, in the printing area A2, which is deemed to have a substantially constant static load throughout the area 2, the measurement positions may be sparsely set or set to positions near an expected maximum load application position. In the exemplary embodiment, the measurement positions has 3 positions that include each position in each of a space adjustment area A1, a printing area A2, and a standby area A3 for the sake of convenient explanation.

The carriage 21 is moved, for example, from the standby area A3 to the space adjustment area A1, at a position P1 in FIG. 6 just before an expected maximum load application position (S30). At this time, the duty value of the carriage motor 3 may be set to any values enough to move the carriage 21, so that the duty value may be set to 100%. Then, a relevant initial reference duty value stored in the EEPROM 603 in association with the areas, is read therefrom. The read duty value is set to the carriage motor drive circuit 4 (S31).

In this embodiment, the duty value data for the carriage motor 3 is stored in the memory areas 603*a*, 603*b*, 603*c* of the EEPROM 603 in association with the space adjustment area A1, the printing area A2, and the standby area A3, respectively. Accordingly, when the carriage 21 is in the position P1 shown in FIG. 6, the duty value for the carriage motor 3 is read from the memory area 603*a* of the EEPROM 603.

By driving the carriage motor 3 based on the duty value read from the memory area 603*a*, it is determined, based on information from the detector 5, whether the carriage 21 is moved or not. In order words, it is determined whether the condition of the carriage 21 is changed from the static condition (stationary or unmoving condition), to the dynamic condition (moving or operating condition) (S32). More specifically, the determination as to whether the carriage 3 is moved, is made by detecting whether the carriage 21 is moved to a distance of at least two slits 500 of the encoder strip 50. With this determination, a correct detection of the carriage 21 movement can be made, even when the carriage 21 is vibrated by the reception of the drive force from the carriage motor 3, and seems to move to a distance of about one slit 500.

Alternatively, the following determination may be made in S32 as to whether the carriage 21 is moved in the areas, such as in the space adjustment area A1 and standby area A3, where big fluctuations in the applied loads are expected. The moving range of the carriage 21 is set to, for example, positions P1 to P2 in FIG. 6, to include the expected maximum load application position. It may be determined in S32 whether the carriage 21 is moved from the start position P1 to the target end position P2, instead of determining whether the carriage 21 is moved to the distance of two slits 500.

When it is determined that the carriage 21 is moved (S32: YES), the duty value at the time when the carriage 21 is moved is temporarily stored in the RAM 602 (S33). Then, the carriage 21 is moved back to the start detection position (S34). The duty value set in S31 is changed to a lower duty value, for example, by a predetermined amount. The lower duty value is set in the carriage motor drive circuit 4. Based on the set lower duty value, the carriage motor 3 is driven to move the carriage 21 (S35). When it is determined that the carriage 21 is moved (S36: YES), flow returns to S33. When it is determined that the carriage 21 is not moved (S36: NO), the duty value set in S35 is stored in the RAM 602, as the duty value that does not move the carriage 21 in the detection position (S37).

In S32, when it is determined that the carriage 21 is not moved (S32: NO), the duty value is temporarily stored in the RAM 602, as the duty value that does not move the carriage 21 in the detection position (S38). Thereafter, the duty value set in S31 is changed to a higher duty value, for example, by a predetermined amount. The higher duty value is set in the carriage motor drive circuit 4. Based on the set higher duty value, the carriage motor 3 is driven to move the carriage 21 (S39). When it is determined that the carriage 21 is not moved (S40: NO), flow returns to S38. When it is determined that the carriage 21 is moved (S40: YES), the duty value set in S39 is stored in the RAM 602, as the duty value that moves the carriage 21 in the detection position (S41).

The two duty values obtained through S37 or S41 are stored in the RAM 602. The two duty values stored in the RAM 602 are overwritten into the memory area 603*a* of the EEPROM 603, as the duty values that moves and does not move the carriage 21 in space adjustment area A1, in which the detection position is included (S42).

Thereafter, it is determined that the alternative characteristic values are obtained at all detection positions (S45). It is determined that the alternative characteristic values are not obtained at all detection positions (S45: NO), the carriage 21 is moved to a next detection position (S43). An initial reference duty value stored in the EEPROM 603 in association with the next detection position, is read from the EEPROM 603. The read duty value is set to the carriage motor drive circuit 4 (S44). When the carriage 21 is in the printing area A2, the duty value for the carriage motor 3 is read from the memory area 603*b* of the EEPROM 603. When the carriage 21 is in the standby area A3, the duty value for the carriage motor 3 is read from the memory area 603*c* of the EEPROM 603.

When it is determined that the alternative characteristic values are obtained at all detection positions, through S32 to S42, (S45: YES), the alternative characteristic value obtaining process ends.

As the alternative characteristic value obtaining process is performed, the two duty values that move and do not move the carriage 21 are obtained at each detection position. The two duty values are stored in the relevant memory areas 603*a*–603*c* of the EEPROM 603 in association with positional information. The duty value represents the alternative characteristic of the loads on the carriage 21. The loads on the carriage 21 in this embodiment are as shown in FIG. 6.

Use of the printer 1 according to the exemplary embodiment will bring the following effects.

In the above-described alterative characteristic value obtaining process, it is determined in each detection position whether the condition of the carriage 21 is changed from the static condition to the dynamic condition, while changing the drive power supplied to the carriage motor 3. The duty values, which are the alternative characteristic values of the static loads applied to the carriage 21, in each detection position, are stored in the EEPROM 603. Quality control of the printer 1 can be properly performed by reading the duty values from the EEPROM 603 and examining the duty values of the alternative characteristic values.

If a problem is found in the printer 1 after shipment, it can be determined in which moving area of the carriage 21 the problem occurred, by comparing the duty values that have been stored in the EEPROM 603 before shipment and those obtained after the problem is found in the printer 1.

The process for obtaining the alternative characteristic values for the carriage 21 when the carriage 21 is moved along the guide shaft 20, is described as an example in the embodiment, for the simplicity of description, instead of describing alternative characteristic value obtaining processes for all mechanical modules provided in the printer 1. For example, when the alternative characteristic values are used for relevant mechanical modules for the drive controls, such as for sheet feeding and print heads other than those for the carriage 21, it is preferable that an alternative characteristic value obtaining process similar to that described above be performed for a plurality of mechanical modules that are to be controlled and the obtained alternative characteristic values be stored in a memory.

With the structures, the alternative characteristic values for the plurality of the mechanical modules to be controlled are stored in the memory. Therefore, if a malfunction occurs in the printer 1, the cause of the malfunction can be found by comparing the duty values that have been stored in the memory before and after the occurrence of the malfunction in the printer 1.

Generally, static load will be an issue for the operation controls of carriages in printers. In this embodiment, the static load can be detected by detecting the condition changes from the static condition to the dynamic condition. Thus, quality control for the printer 1 can be properly performed.

In the exemplary embodiment, the duty values are obtained in all moving ranges of the carriage 21. However, the duty values may be obtained with respect to areas designated by the operation of the operation device 61. The areas designated by the operation of the operation device 61 may be the space adjustment area A1 where the space adjustment device 26 is disposed to adjust the space between the print head 22 and the sheet α, the printing area A2 where the print head 22 performs printing onto the sheet α, and the standby area A3 where the capping device 25 is disposed and the print head 22 stands by when the printing operation is not performed. The areas may be separately designated and the duty values in only designed areas may be detected. With this structure, the duty value of only the designated area can be effectively checked, such as when the operation of an area is checked, or analysis of a problem is conducted after shipment.

In the exemplary embodiment, the printer 1 is structured to communicate with an external device, such as a personal computer (PC), so that the duty value data stored in the EERPOM 603 can be sent to the PC according to the request from the PC, and displayed in the PC. Because the PC has a wider monitor or display area than the monitor 62 of the printer 1, more information can be displayed in the PC than the printer 1. Therefore, when the duty value data is sent to the PC, additional information may be sent to the PC and displayed therein.

While the invention has been described with reference to the exemplary embodiment, it is to be understood that the invention is not restricted to the particular forms shown in the foregoing embodiment. Various modifications and alterations can be made thereto without departing from the scope of the invention, as set forth in the appended claims.

For example, in the above-described embodiment, only one duty value that moves the carriage 21 and only one duty value that does not move the carriage 21 are stored in the EEPROM 603 in association with the positional information. However, a plurality of the duty values may be obtained by detecting at the same detection position a plurality of times (or at a plurality of detection positions in the same Area), and at least one of maximum and minimum duty values of the plurality of the duty values may be stored in the EEPROM 603 in association with the positional information. Instead, a plurality of the duty values may be obtained by detecting at the same detection position a plurality of times (or at a plurality of detection positions in the same Area), and the average of the plurality of the duty values or the average of the maximum and minimum duty values may be stored in the EEPROM 603. The average of the duty values will be more reliable or less affected by the environment at the time of the detection than one duty value. To facilitate the calculation of the average, only the maximum and minimum duty values may be used.

In the exemplary embodiment, the duty value is used as the alternative characteristic value. However, the drive power, drive force value, or current of the drive power supplied to the carriage motor 3 may be used as the alternative characteristic value.

If any one of the duty values obtained by the alternative characteristic value obtaining process and stored in the EEPROM 603 exceeds a predetermined value (e.g. 80%), the printer 1 may be determined as a defective or non-conforming product and a message indicating as such may be displayed on the monitor 62.

The embodiment is described in conjunction with the printer 1 as an example of an electronic device. However, the invention is not limited to printers, but may also be applied to any electronic devices including mechanical modules that are to be electronically controlled.

The carriage motor 3 may correspond to a drive source. The PWM control performed by the drive circuits 4, 71 and the controller 6 may correspond to a power supply device. The sheet α may correspond to a print medium. The operation device 61 may correspond to an input device. The input/output interface 53 may correspond to a communication device. The personal computer may correspond to an information processing device.

What is claimed is:

1. An electronic device including a mechanical module, comprising:

a drive source that provides drive force to the mechanical module;

a power supply device capable of supplying drive power to the drive source while changing the drive power;

a detector that detects a condition change of the mechanical module from a static condition to a dynamic condition, when the power supply device supplies the drive power to the drive source; and a storage device that stores a value, at a time of detection by the detector, that is associated with the drive force of the drive source or the drive power, as an alternative characteristic value of static load on the mechanical module.

2. The electronic device according to claim 1, wherein the mechanical module includes a guide shaft, a carriage that reciprocates along the guide shaft, a print head mounted on the carriage, and a transmission device that transmits the drive force from the drive source to the carriage, and the detector detects the condition change of the carriage, from the static condition to the dynamic condition, along the guide shaft.

3. The electronic device according to claim 2, wherein the detector detects at a plurality of detection positions which are set throughout a moving range of the carriage and the alternative characteristic value obtained at each of the plurality of the detection positions is stored in the storage device.

4. The electronic device according to claim 3, wherein at least one of the plurality of the detection positions is included in each of a space adjustment area where space between the print head and a print medium is adjusted, a printing area where the print head performs printing onto the print medium, and a standby area where the print head stands by when the print head does not perform printing.

5. The electronic device according to claim 4, further comprising a calculation device that calculates at least one of maximum and minimum values associated with the drive force or the drive power, wherein the detector detects at a plurality of detection positions in a determined area, the calculation device calculates the at least one of the maximum and minimum values of a plurality values that are detected by the detector, and the calculated value is stored in the storage device, as the alternative characteristic value for the determined area.

6. The electronic device according to claim 4, further comprising a calculation device that calculates an average of values associated with the drive force or the drive power, wherein the detector detects at a plurality of detection positions in a determined area, the calculation device calculates the average of a plurality values that are detected by the detector, and the calculated average is stored in the storage device, as the alternative characteristic value for the determined area.

7. The electronic device according to claim 4, further comprising a calculation device that calculates an average of values associated with the drive force or the drive power, wherein the detector detects at a plurality of detection positions in a determined area, the calculation device calculates the average of maximum and minimum values of the plurality values that are detected by the detector, and the calculated average is stored in the storage device, as the alternative characteristic value for the determined area.

8. The electronic device according to claim 1, further comprising a calculation device that calculates at least one of maximum and minimum values associated with the drive force or the drive power, wherein the detector detects at one detection position a plurality of times, the calculation device calculates the at least one of the maximum and minimum values of a plurality of values that are detected by the detector, and the calculated value is stored in the storage device, as the alternative characteristic value for the one detection position.

9. The electronic device according to claim 1, further comprising a calculation device that calculates an average of values associated with the drive force or the drive power, wherein the detector detects at one detection position a plurality of times, the calculation device calculates the average of a plurality values that are detected by the detector, and the calculated average is stored in the storage device, as the alternative characteristic value for the one detection position.

10. The electronic device according to claim 1, further comprising a calculation device that calculates an average of values associated with the drive force or the drive power, wherein the detector detects at one detection position a plurality of times, the calculation device calculates the average of maximum and minimum values of a plurality values that are detected by the detector, and the calculated average is stored in the storage device, as the alternative characteristic value for the one detection position.

11. The electronic device according to claim 1, further comprising:

an input device that inputs a start of storing the alternative characteristic value into the storage device; and a display device that displays a status of the mechanical module as to whether the mechanical module is conforming or nonconforming, based on the alternative characteristic value stored in the storage device; and wherein as the input device inputs the start of storing the alternative characteristic value into the storage device, the display device displays the status of the mechanical module as to whether the mechanical module is conforming or nonconforming.

12. The electronic device according to claim 1, further comprising a communication device that is connected to an information processing device to send information thereto and receive the information therefrom, wherein when the information processing device makes a request to send the alternative characteristic value thereto, the alternative characteristic value stored in the storage device is sent to the information processing device, through the communication device.

13. The electronic device according to claim 1, wherein the storage device is a non-volatile memory.

14. The electronic device according to claim 1, wherein the value associated with the drive force of the drive source or the drive power stored in the storage device as the alternative characteristic value is an electric current value or a pulse width modulation duty value.

15. A method for obtaining an alternative characteristic value, the method being executed in an electronic device including a mechanical module, a drive source that provides drive force to the mechanical module, a power supply device capable of supplying drive power to the drive source while changing the drive power, and a storage device that stores therein the alternative characteristic value, the method comprising the steps of:

supplying the drive power from the power supply device to the drive source while changing the drive power;

detecting a condition change of the mechanical module from a static condition to a dynamic condition, when the power supply device supplies the drive power to the drive source while changing the drive power in the supplying step; and storing in the storage device a value, at a time of detection in the detecting step, that is associated with the drive force of the drive source or the drive power, as the alternative characteristic value of static load on the mechanical module.

16. The method according to claim 15, wherein the mechanical module includes a guide shaft, a carriage that reciprocates along the guide shaft, a print head mounted on the carriage, and a transmission device that transmits the drive force from the drive source to the carriage, and the detecting step detects the condition change of the carriage, from the static condition to the dynamic condition along the guide shaft, when the power supply device supplies the drive power to the drive source while changing the drive power.

17. The method according to claim 16, wherein the detecting is performed at a plurality of detection positions and the alternative characteristic value obtained at each of the plurality of the detection positions is stored in the storage device.

18. The method according to claim 17, wherein at least one of the plurality of the detection positions is included in each of a space adjustment area where space between the print head and a print medium is adjusted, a printing area where the print head performs printing onto the print medium, and a standby area where the print head stands by when the print head does not perform printing.

19. The method according to claim 18, further comprising a calculating step in which at least one of maximum and minimum values associated with the drive force or the drive power is calculated, wherein the detecting is made at a plurality of detection positions of a determined area, the at least one of the maximum and minimum values of a plurality of values, that are detected by the detector, is calculated in the calculation step, and the calculated value is stored in the storage device, as the alternative characteristic value for the determined area.

20. The method according to claim 18, further comprising a calculating step in which an average of values associated with the drive force or the drive power is calculated, wherein the detecting is performed at a plurality of detection positions of a determined area, the average of the plurality of values that are detected by the detector is calculated in the calculation step, and the calculated value is stored in the storage device, as the alternative characteristic value for the determined area.

21. The method according to claim 18, further comprising a calculating step in which an average of values associated with the drive force or the drive power is calculated, wherein the detecting is performed at a plurality of detection positions of a determined area, the average of maximum and minimum values of the plurality of values that are detected by the detector is calculated in the calculation step, and the calculated value is stored in the storage device, as the alternative characteristic value for the determined area.

22. The method according to claim 15, further comprising a calculating step in which at least one of maximum and minimum values associated with the drive force or the drive power is calculated, wherein the detecting is performed at one detection position a plurality of times, the at least one of the maximum and minimum values of a plurality of values, that are detected by the detector, is calculated in the calculation step, and the calculated value is stored in the storage device, as the alternative characteristic value for the one detection position.

23. The method according to claim 15, further comprising a calculating step in which an average of values associated with the drive force or the drive power is calculated, wherein the detecting is performed at one detection position a plurality of times, the average of the plurality of values that are detected by the detector is calculated in the calculation step, and the calculated value is stored in the storage device, as the alternative characteristic value for the one detection position.

24. The method according to claim 15, further comprising a calculating step in which an average of values associated with the drive force or the drive power is calculated, wherein the detecting is performed at one detection position a plurality of times, the average of maximum and minimum values of the plurality of values that are detected by the detector is calculated in the calculation step, and the calculated value is stored in the storage device, as the alternative characteristic value for the one detection position.

25. The method according to claim 15, further comprising the steps of:

inputting a start of storing the alternative characteristic value into the storage device; and displaying a status of the mechanical module as to whether the mechanical module is conforming or nonconforming, based on the alternative characteristic value stored in the storage device; and wherein as the start of storing the alternative characteristic value into the storage device is input, the status of the mechanical module as to whether the mechanical module is conforming or nonconforming is displayed.

26. The method according to claim 15, further comprising the step of sending the alternative characteristic value stored in the storage device to an information processing device, when a request for sending the alternative characteristic value is externally made by the information processing device.

27. The method according to claim 15, wherein the storage device is a non-volatile memory.

28. The method according to claim 15, wherein the value associated with the drive force of the drive source or the drive power stored as the alternative characteristic value is an electric current value or a pulse width modulation duty value.

* * * * *